US005261125A

United States Patent [19]

Cartwright et al.

[11] Patent Number: 5,261,125

[45] Date of Patent: Nov. 16, 1993

[54] HEAD IMPACT FORCE DIVERSION SYSTEM

[76] Inventors: Rudolph Cartwright, #14 Lake Park Rd., Champaign, Ill. 61821; John E. Lowe, 9000 S. Bennett, Chicago, Ill. 60617

[21] Appl. No.: 818,310

[22] Filed: Jan. 8, 1992

[51] Int. Cl.[5] ..... A42B 3/04; A63B 71/10

[52] U.S. Cl. ..... 2/421; 2/425; 602/17; 602/18

[58] Field of Search ..... 2/2, 3 R, 421, 425, 2/44, 45, 415, 416, 419, 422; 602/5, 12, 16, 17, 18, 19; 128/857, 869, 870, 874, 875, 876

[56] References Cited

U.S. PATENT DOCUMENTS

| | | | |
|---|---|---|---|
| 1,136,307 | 4/1915 | Bourdon . | |
| 1,301,276 | 4/1919 | Kroetz . | |
| 3,134,106 | 5/1964 | Shaffer et al. | 2/425 |
| 3,671,974 | 6/1972 | Sims . | |
| 3,818,509 | 6/1974 | Romo et al. . | |
| 3,873,996 | 4/1975 | Varteressian | 2/421 |
| 3,900,896 | 8/1975 | Ackerman . | |
| 4,825,476 | 5/1989 | Andrews . | |
| 5,123,408 | 6/1992 | Gaines | 2/425 |

*Primary Examiner*—Clifford D. Crowder
*Assistant Examiner*—Larry D. Worrell, Jr.
*Attorney, Agent, or Firm*—Kenyon & Kenyon

[57] ABSTRACT

A head impact force diversion system utilizes an apertured helmet, a rigid transfer arm, and a vest. The helmet, possessing an opening associated with an elevation which may be pivotable upon the helmet or integral with its surface, and vest are worn in a conventional manner. The rigid transfer arm is mounted and affixed to the vest and extends upward from the mounting, arches near and enters the aperture of the helmet, and terminates underneath the elevation. This system permits the usual range of motion of the head and neck during various activities and protects the head and neck when the helmet receives an impact force.

13 Claims, 5 Drawing Sheets

HEAD IMPACT FORCE DIVERSION SYSTEM

BACKGROUND OF THE INVENTION

1. Field of the Invention

The present invention relates to an impact force diversion system. More specifically, the invention relates to a helmeted device that permits full range of motion of the head and neck during normal activities and, in the event of an impact force to the helmet, transfers that impact force onto an arm affixed to a vest worn about the torso.

2. Description of the Prior Art

A number of devices have been proposed for absorbing the shock of a blow to a helmeted person. These devices generally affix to another part of the body. Examples of this are Romo et al., U.S. Pat. No. 3,818,509; Ackerman, U.S. Pat. No. 3,900,896; Sims, U.S. Pat. No. 3,671,974; and Andrews, U.S. Pat. No. 4,825,476.

Romo et al., disclose the use of a helmet which has been elastically fixed to a set of shoulder pads by flexible straps.

The Ackerman reference shows a pivotable, rigid device which restrains any forward, rearward, and lateral movement of the head, but permits some small degree of rotation of the head due to the pivotal mounting of the restraining bar in the shoulder pad.

Sims discloses the use of rings and hooks affixing the rear portion of the helmet to the shoulder pads to prevent hyperflexion of the head forwardly during athletic activity. Sims' device is designed merely to prevent forward movement of the wearer's neck in a dangerous manner.

The device disclosed in the Andrews reference utilizes a pivotal mounted helmet that may rotate on a track which surrounds the neck of the wearer. The head may then be rotated from right to left and the pivoted mounting of the helmet on the rotatable track permits forward and rearward movement of the head as well. While the device is adapted to receive a blow and transmit that force to the shoulders of the wearer, it restricts the range of motion of the head and neck by not allowing circumduction.

What is disclosed in the prior art, therefore, are devices which prevent any movement of the head and neck relative to the shoulders of the wearer or devices which attempt to absorb the shock of a blow without permitting the usual range of motion of the wearer's head and neck. Thus, what is lacking in the art is a system that allows the user full range of motion of the head and neck and, in the event of an impact force to the head, protects the head and neck.

SUMMARY OF THE INVENTION

A helmet-arm-vest impact force diversion system is proposed which allows the user the usual range of motion of the head and neck and, in case of an impact force to the helmet, diverts and transfers the force of impact to the vest.

The helmet is secured to the user's head in a conventional manner. The vest is likewise strapped onto the user's torso. The helmet possesses an aperture which may be associated with an elevation on its external surface. A segment of the first end of an arm, entering the aperture and situated underneath the elevation, is fashioned to transfer a force of impact from the helmet onto the vest to which the second end of the arm is attached. This system is intended to prevent injury not only to the user's head but also to the user's neck and to permit their usual range of movement during ordinary activities.

These and other advantages and features of the present invention will be more fully understood with reference to the presently preferred embodiments and to the appended drawings.

DESCRIPTION OF THE PREFERRED EMBODIMENTS

Figure 1:
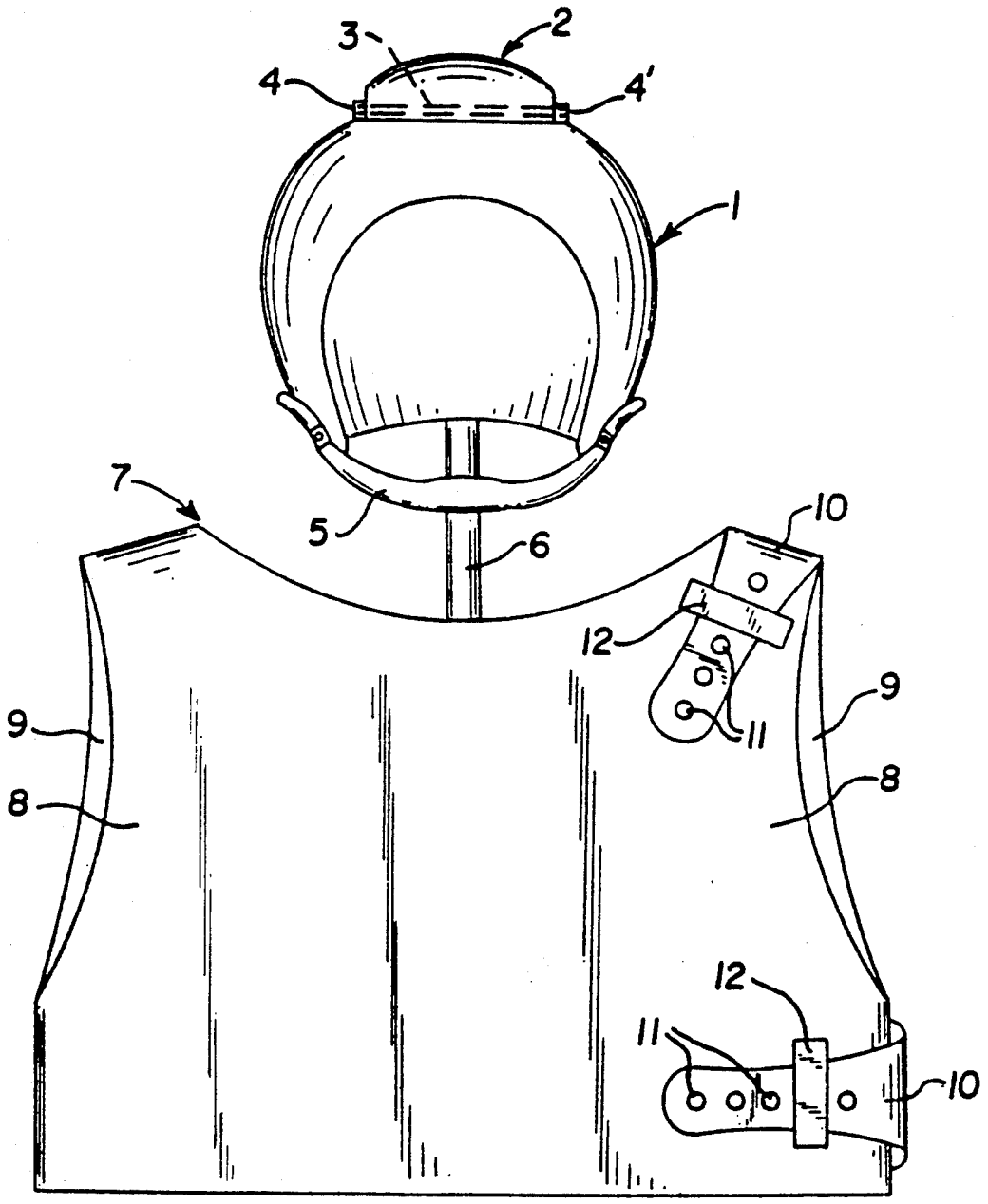
FIG. 1 is a front view of the impact force diversion system.

Referring to FIG. 1, a front view of the system shows helmet 1 having elevation 2 hinged anteriorly to the helmet by rotating pin 3 which is shown in broken line passing through pinholes 4'. A chin strap 5 is optionally provided to secure the helmet 1 on the user's head. Helmet 1 is positioned over transfer arm 6; and the first end of transfer arm 6 enters the aperture in the rear and terminates unfixed underneath the elevation 2. The second end of transfer arm 6 is affixed to vest 7 desirably by a screw provided in the rear of the vest, as will be described later.

While elevation 2 is illustrated at its preferable location, the crown of the helmet, and hinged anteriorly, it may be located at any position on the helmet and hinged from any aspect to the helmet.

The hinged elevation has a locking and rotating mechanism that will be further illustrated and described with reference to FIGS. 4 and 5.

In further reference to FIG. 1, vest 7 is shown having a front section 8 and a rear section 9. Extending from rear section 9 are upper and lower straps 10 provided with engagement holes 11. These straps preferably affix rear section 9 to front section 8 by utilizing upper and lower straps locking means 12 that are affixed to front section 8. Although not specifically illustrated in the Figure, similar straps locking means can be provided on both sides of the vest. It should be noted that any type of fastening or locking means may be utilized in conjunction with the vest.

Figure 2:
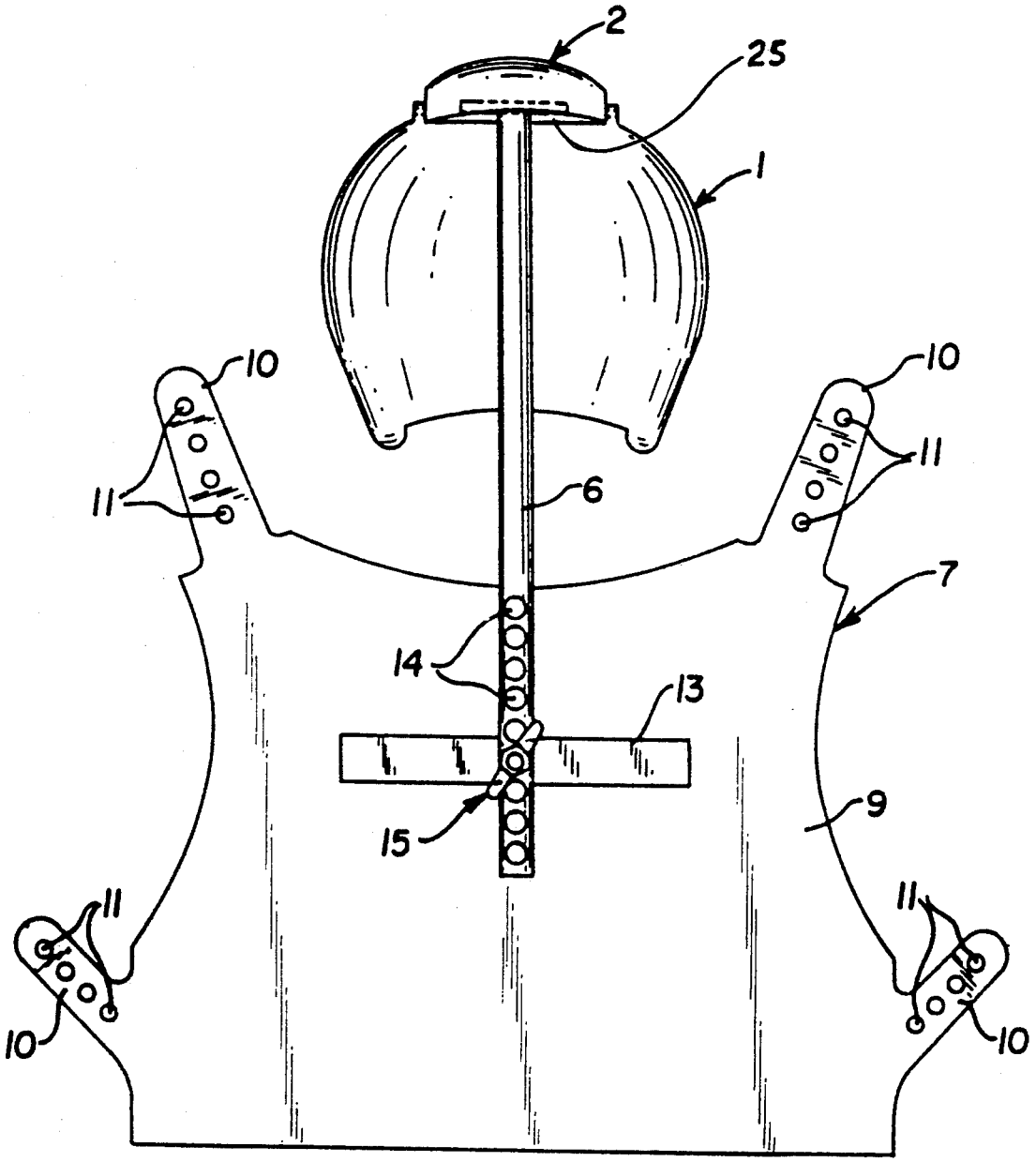
FIG. 2 is a rear view of the impact force diversion system.

FIG. 2 illustrates a rear view which exhibits transfer arm mounting bracket 13 being affixed to rear section 9 of vest 7. The second end of transfer arm 6 is positioned and mounted upon the transfer arm mounting bracket by using one of the plurality of transfer arm holes 14 situated in the transfer arm. As shown in the figure, a transfer arm locking means 15 firmly secures transfer arm 6 to transfer arm mounting bracket 13. Transfer arm 6 extends upward from its mounted position on mounting bracket 13 and its first end arches near the surface of helmet 1, entering the aperture and terminates, being neither attached nor affixed, such that elevation 2 is positioned over it. This arrangement ensures the usual range of motion of the user's head and neck and, in the event of an impact force to the helmet, the diversion and transference of the impact force to the transfer arm mounted to the bracket.

Transfer arm mounting bracket 13 is formed of a rigid member and preferably constructed of metal. While transfer arm 6 is most preferentially mounted at its center on mounting bracket 13, it should be especially noted that it may be mounted on the mounting bracket at any one of its transfer arm holes 14. Such asymmetrical mounting may be dictated by anatomical requirements of the user or merely for his or her comfort. Moreover, any one of a number of conventional clamping means may be used to secure transfer arm 6 to transfer arm mounting bracket 13.

Figure 3:
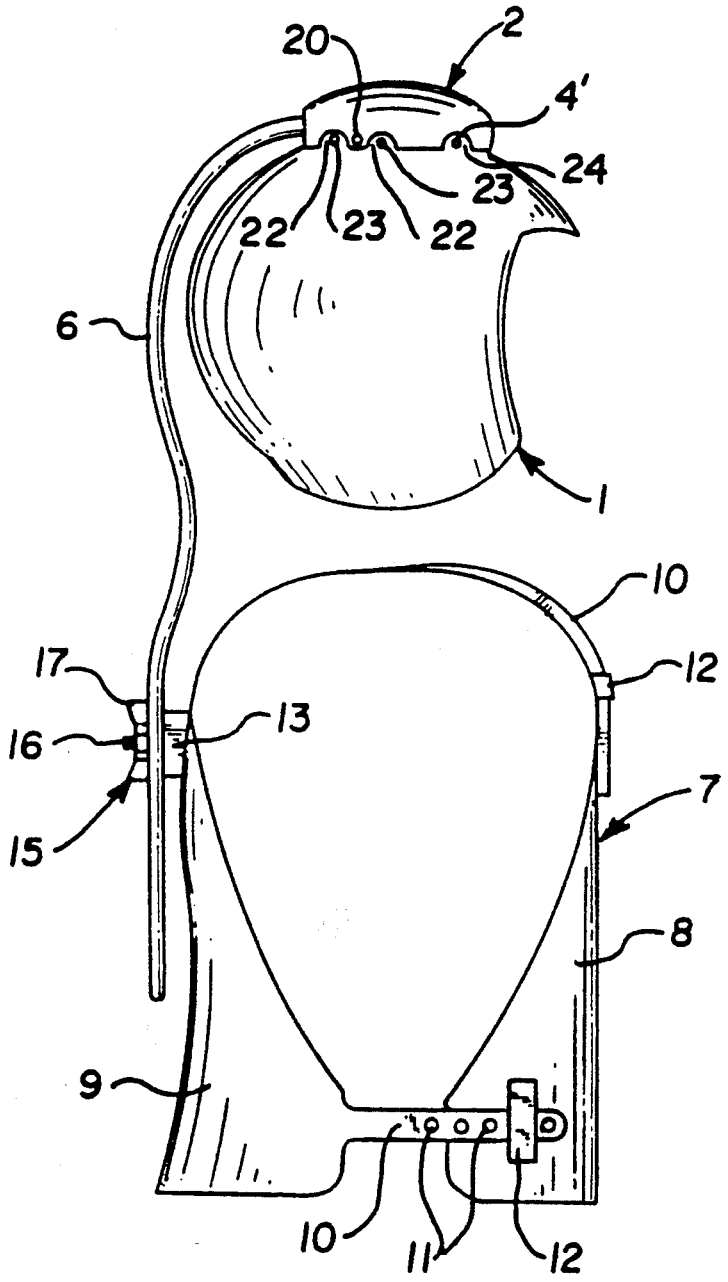
FIG. 3 is a side view of the impact force diversion system.

FIG. 3 illustrates the side view of the entire system completely assembled. The rear section 9 of vest 7 is affixed to front section 8 utilizing the upper and lower straps 10 extending from rear section 9 and engaging locking means 12 of front section 8. It should be observed that a portion of the rear vest section 9 may overlap a portion of the front section 8 for the comfort of the wearer.

As previously indicated, the second end of transfer arm 6 is mounted to transfer arm mounting bracket 13 and secured to it utilizing transfer arm locking means 15. This transfer arm locking means is preferably comprised of a threaded bolt 16, which extends outwardly from transfer arm mounting bracket 13, and lock nut 17 which clamps transfer arm 6 to transfer arm mounting bracket 13. It should be particularly noted that any conventional mounting means may be utilized and that a plurality of such mounting means may also be utilized to further insure the fixed positioning of transfer arm 6 on the rear section 9 of vest 7. For purposes of clarity, the chin strap 5 shown in FIG. 1 is not illustrated in this figure; and items numbered 20, 22, 23, 24, and 4' will be designated in FIG. 4 below.

Figure 4:
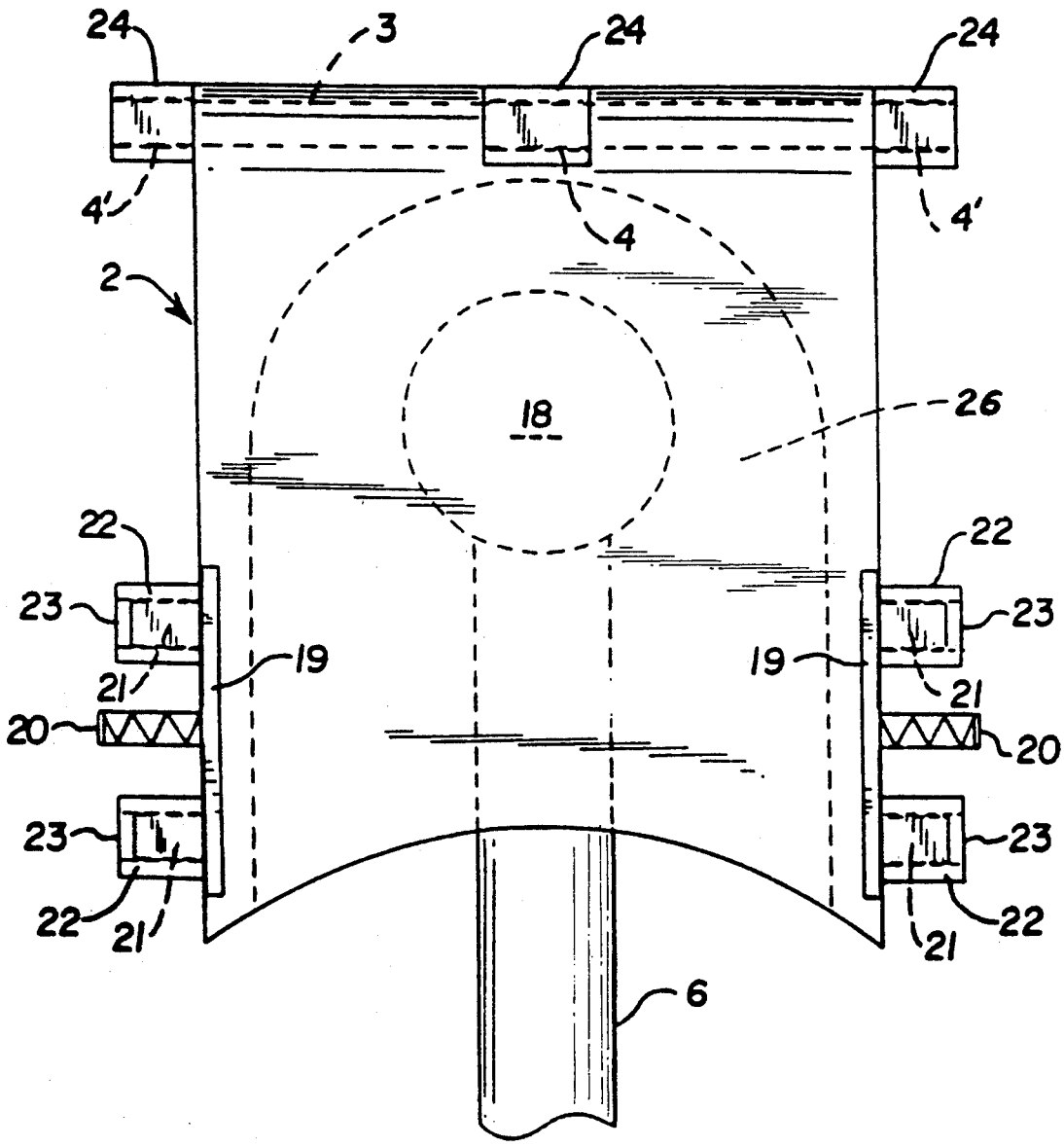
FIG. 4 is a top plan view of the upper surface of the hinged elevation of the helmet.

FIG. 4 illustrates the top surface view of elevation 2 having a segment of the first end of Transfer arm 6 extending forward through the aperture 25 (see FIG. 2) in the elevation and terminating, unfixed, as an expansion 18. Transfer arm 6 and expanded end 18 are shown in broken line to indicate their position underneath the elevation which defines a cavity 26 therein, within which the end of the transfer arm 6 and the expanded region 18 are free to move relative to the elevation 2 (see FIGS. 4 and 5*a*). While the aperture in the elevation is preferentially located at the rear, it may be located at any aspect of the elevation.

As noted, elevation 2 possesses a locking and rotating mechanism which secures it to helmet 1. The mechanism, located on each side of elevation 2, consists of support plate 19, push-button 20, two locking pins 21, two locking bosses 22 with engagement holes 23, and a rotational boss 24 with pinholes 4'.

Push-button 20, affixed to each support plate 19, is resiliently biased in an outward position such that support plate 19 is pressed against the interior surface of elevation 2; and locking pins 21, also affixed to support plate 19 and fashioned to interlock with engagement holes 23 of locking boss 22, rest in a protruding position to lock the elevation to the helmet. When elevation 2 is in the locked position having locking pins 21 secured to locking bosses 22 by engagement holes 23, depressing push-buttons 20 in an inward fashion serve to retract locking pins 21 within the body of elevation 2 which disengage the locking mechanism from locking boss 22. Releasing push-buttons 20 serve to extend locking pins 21 from the body of elevation 2 which reengage the locking mechanism with engagement holes 23 of locking bosses 22.

Elevation 2 pivots on rotating pin 3, as shown in the broken line positioned within pinholes 4 and 4', and assists in securing elevation 2 to helmet 1, as shown in FIG. 3. Further details of the locking and rotating mechanism will be described below with reference to FIG. 5.

Figure 5:
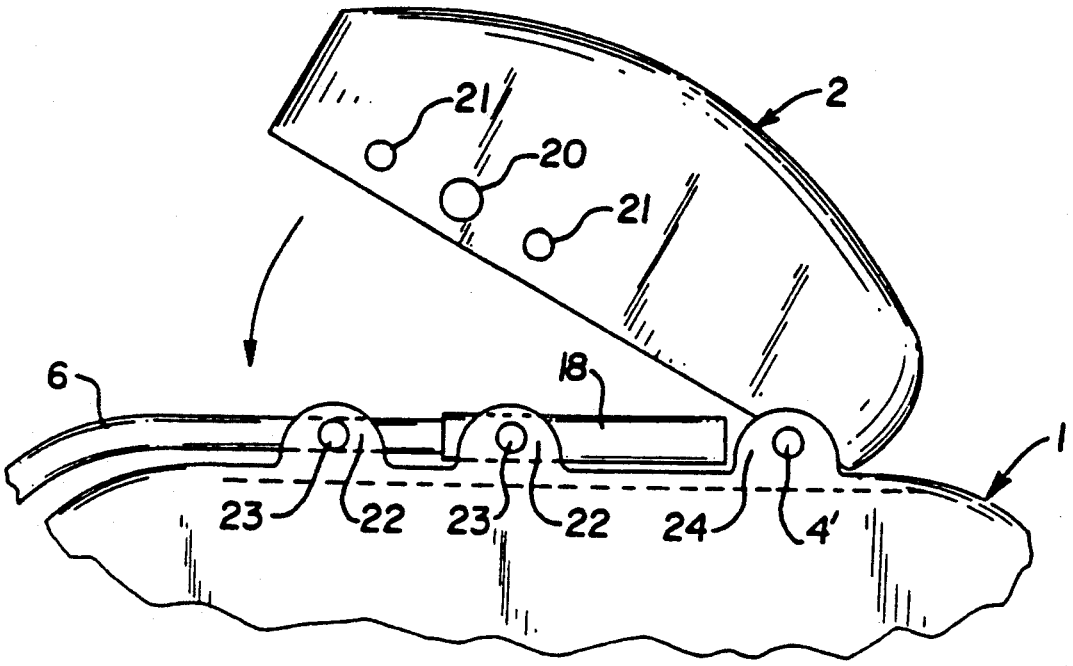
FIG. 5 is a side view of the hinged elevation in the opened position and the first end of the transfer arm underneath.

FIG. 5 illustrates a side view of helmet 1 shown having hinged elevation 2 unlocked and rotated to the opened position. Two locking bosses 22 provided with engagement holes 23, and a rotational boss 24 with rotation pinholes 4' serve to restrain the pivotable elevation 2 in operation. Rotation pinhole 4', provided within rotational boss 24, is coaxially aligned with pinholes 4 (not shown) of pivotable elevation 2. Rotating pin 3, although not shown in this figure, extends through pinholes 4 (not shown) and 4' to permit pivotable rotation of elevation 2 at that point.

When elevation 2 is in the opened position as shown in the Figure, it may be rotated in the direction of the arrow; upon depressing push-buttons 20, locking pins 21 retract within the body of elevation 2 allowing alignment of them with pinholes 23. Releasing push-buttons 20 after alignment permit locking pins 21 to extend into engagement holes 23, thus locking the elevation firmly to the helmet. In order to unlock elevation 2 from its engagement with helmet 1, push-buttons 20 are depressed, retracting locking pins 21 within the body of elevation 2 and out of engagement holes 23; elevation 2 is then pivoted on rotating pin 3 in the direction opposite that of the arrow shown in the Figure. When elevation 2 is in the opened position, the helmet 1 can be put on and taken off by the wearer without removal of vest.

Figure 5A:
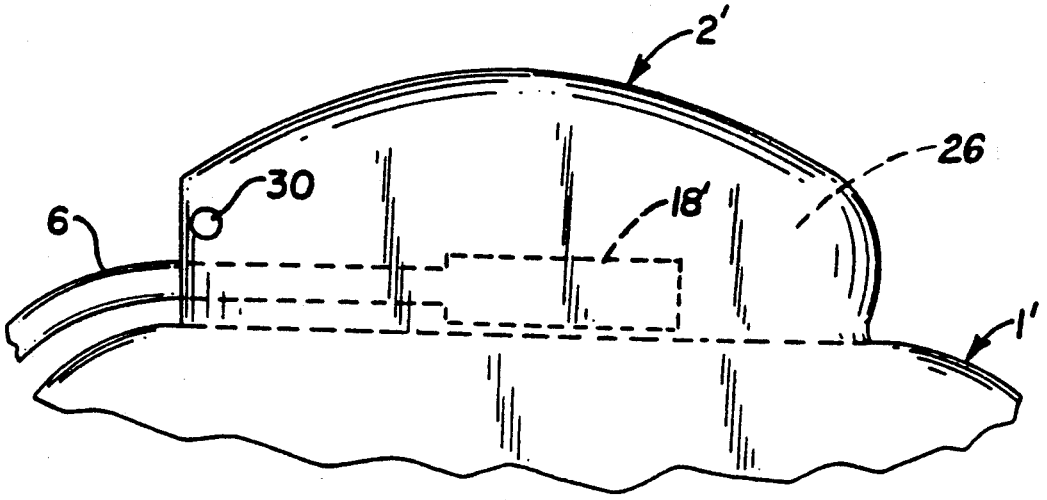
FIG. 5*a* is a side view of the elevation in an integral embodiment.

Although elevation 2 is most preferentially pivotally mounted to helmet 1 and secured by a locking mechanism, the elevation may be integral with the surface of the helmet without such pivotable mounting and locking instrument, as shown in FIG. 5*a*. A removable locking pin 30 is passed through integral elevation 2' and is utilized to restrain the expansion 18' of transfer arm 6 in the space beneath elevation 2'.

While a present preferred embodiment of the invention is described, it is to be distinctly understood that the invention is not limited thereto, but may be otherwise embodied and practiced within the scope of the following claims.

What we claim:

1. An apparatus for mounting upon a head and a torso of a human body for absorbing an impact force to said head and transferring that impact force to the torso, comprising:

a) torso attachment means for mounting upon said torso;

b) head protection means for mounting upon said head, said head protection means including an elevation with at least one aperture defined therein;

c) means for pivotably mounting said elevation to said head protection means; and d) transfer means, affixed at a second end to said torso attachment means, extending through the aperture defined in the elevation of the head protection means and terminating at a first end having an expanded region, said first end being movably disposed within a cavity in the elevation.

2. An apparatus as described in claim 1, wherein said elevation has an open and a closed position.

3. An apparatus as described in claim 2, wherein said elevation, when in the closed position, covers said first end of said transfer means, said first end of said transfer means terminating adjacent said head protection means.

4. An apparatus as described in claim 3, wherein said elevation further comprises a locking mechanism.

5. An apparatus as described in claim 4, wherein said locking mechanism comprises:

a) at least one retractable pin associated with the elevation, b) means belonging to the head protection means for engaging said pin and for restraining movement of said pin to lock the elevation to the head protection means, and c) means for selectively retracting said pin for disengaging said pin from said engagement means.

6. An apparatus as described in claim 5 further comprising a biasing means for resiliently biasing said pin outwardly from said elevation to engage the engaging means.

7. An apparatus as described in claim 5, wherein the engaging means comprises at least one boss mounted adjacent said elevation, said boss adapted to receive and restrain said retractable pin.

8. An apparatus as described in claim 1, wherein said head protection means is a helmet.

9. An apparatus as described in claim 1, wherein said head protection means further comprises a strap for securing said head protection means to said head.

10. An apparatus as described in claim 1, wherein said first end of said at least one transfer means is adapted for insertion into at least one aperture of said head projection means, said first end being movably restrained adjacent the surface of said head protection means.

11. An apparatus as described in claim 1, wherein said at least one transfer means further comprises a plurality of mounting sites, said mounting sites allowing for mounting of said at least one transfer means in a corresponding plurality of positions with respect to said torso mounting means.

12. An apparatus as described in claim 1, wherein said transfer means is a rigid arm.

13. An apparatus as described in claim 1, wherein said torso mounting means comprises:

a) a front portion and a rear portion; and b) at least one two part fastening means having a first part affixed to said front portion and having a second part affixed to said rear portion, said first part and second part being engageable to secure said torso mounting means to a torso.

* * * * *